US012121155B2

(12) United States Patent
Hall et al.

(10) Patent No.: US 12,121,155 B2
(45) **Date of Patent: *Oct. 22, 2024**

(54) BED WITH NEGATIVE SPACE

(71) Applicant: Sonu Sleep Corporation, Playa del Rey, CA (US)

(72) Inventors: Bradley Hall, Los Angeles, CA (US); Stason Strong, Playa del Rey, CA (US)

(73) Assignee: SONU SLEEP CORPORATION, Playa Del Rey, CA (US)

( * ) Notice: Subject to any disclaimer, the term of this patent is extended or adjusted under 35 U.S.C. 154(b) by 1043 days.

This patent is subject to a terminal disclaimer.

(21) Appl. No.: 17/071,754

(22) Filed: Oct. 15, 2020

(65) Prior Publication Data

US 2022/0007849 A1 Jan. 13, 2022

Related U.S. Application Data

(63) Continuation of application No. 16/926,502, filed on Jul. 10, 2020, now Pat. No. 10,820,718.

(51) Int. Cl.
*A47C 27/14* (2006.01)
*A47C 27/15* (2006.01)
(Continued)

(52) U.S. Cl.
CPC ..... *A47C 27/146* (2013.01); *A47C 27/144* (2013.01); *A47C 27/148* (2013.01);
(Continued)

(58) Field of Classification Search
CPC ..... A47C 27/14; A47C 27/142; A47C 27/144; A47C 27/146; A47C 27/148; A47C 27/15;
(Continued)

(56) References Cited

U.S. PATENT DOCUMENTS 254,759 A * 3/1882 Young ..... A47C 27/001 5/733
1,295,770 A * 2/1919 Lamont ..... A47C 27/001 5/722
(Continued)

FOREIGN PATENT DOCUMENTS

DE 9003874 7/1990
EP 1048249 11/2000
(Continued)

OTHER PUBLICATIONS

Patent Cooperation Treaty, Notification of Transmittal of The International Search Report and The Written Opinion of the International Searching Authority, or the Declaration, Mailed Dec. 20, 2021, 26 pages.

*Primary Examiner* — David R Hare
(74) *Attorney, Agent, or Firm* — Cislo & Thomas, LLP

(57) ABSTRACT

A bed defining a negative space to accommodate side sleepers and stomach sleepers by providing a space into which the user's arms and shoulders can extend. Channel pillows can be placed inside the negative space to provide support for the user's head while allowing the user's hands and shoulders to slide in between the channel pillow and the wall that define the negative space. The negative space is formed into a foundation having an upper torso region, a lower torso region, and a transition region therebetween. The transition region can comprise an angled wall. A cushion layer with a slanted wall is configured to cover the transition region and lower torso region of the foundation. An upper, comfort layer can be provided with a cutout that aligns with the negative space when placed on top of the foundation and cushion layer.

17 Claims, 9 Drawing Sheets

(51) Int. Cl.
*A47G 9/02* (2006.01)
*A47G 9/10* (2006.01)

(52) U.S. Cl.
CPC ..... *A47C 27/15* (2013.01); *A47G 9/0238* (2013.01); *A47G 9/10* (2013.01)

(58) Field of Classification Search
CPC .... A47C 23/00; A47C 31/105; A47G 9/0238; A47G 9/0246; A47G 9/0253; A47G 9/10; A47G 19/021
USPC ..... 5/730, 731
See application file for complete search history.

(56) References Cited

U.S. PATENT DOCUMENTS 2,207,095 A * 7/1940 Hutchinson ..... A47C 27/125 5/733
2,462,579 A * 2/1949 Warner ..... A47C 27/146 5/733
2,569,627 A 10/1951 Black
2,810,920 A * 10/1957 Carruth ..... A47C 20/026 5/725
3,146,469 A * 9/1964 Slade ..... A47C 27/15 5/699
3,363,272 A 1/1968 Channon
3,378,861 A 4/1968 Lousberg
3,623,170 A * 11/1971 Staley ..... A61G 7/02 5/908
3,654,646 A 4/1972 McMahon
3,742,528 A * 7/1973 Munch ..... A47C 27/20 5/651
3,846,857 A 11/1974 Weinstock
3,874,010 A * 4/1975 Geary ..... A47C 19/045 5/607
3,885,258 A 5/1975 Regan
4,053,957 A 10/1977 Regan
4,193,150 A 3/1980 Vineberg
4,244,066 A 1/1981 Rukawina
4,290,155 A * 9/1981 Hanson ..... A47C 15/008 5/722
4,536,906 A * 8/1985 Varndell ..... A47C 21/046 5/725
4,628,557 A * 12/1986 Murphy ..... A47C 27/148 5/724
4,706,313 A * 11/1987 Murphy ..... A47C 27/148 5/737
4,901,384 A * 2/1990 Eary ..... A47C 20/021 D6/601
4,932,344 A 6/1990 Tatum
4,947,500 A * 8/1990 Seiler ..... A47C 27/18 5/713
D313,721 S 1/1991 Parker
5,048,137 A 9/1991 Rogers
5,107,558 A * 4/1992 Luck ..... A47C 27/15 5/702
5,117,517 A 6/1992 Su
5,129,115 A 7/1992 Higgins et al.
5,189,744 A 3/1993 Roberts
D337,686 S 7/1993 Parker
5,224,226 A 7/1993 Groenewald
5,231,717 A * 8/1993 Scott ..... A47C 31/123 5/400
5,247,714 A * 9/1993 Lipps ..... A47C 27/15 5/733
5,398,354 A * 3/1995 Balonick ..... A47C 27/20 5/922
D357,595 S 4/1995 Roschacher
D364,464 S 11/1995 Gigante et al.
5,528,784 A * 6/1996 Painter ..... A47G 9/10 5/636
5,671,492 A 9/1997 Simon
D396,771 S 8/1998 Iannuzzi
6,085,373 A 7/2000 Montana
6,105,187 A 8/2000 Gnjatovic
6,516,481 B1 * 2/2003 Erickson ..... A47C 27/144 5/724
D479,082 S 9/2003 Daughtery et al.
6,807,698 B2 10/2004 Torbet et al.
6,895,614 B1 5/2005 Peck
6,925,670 B2 8/2005 Torrez
D509,981 S 9/2005 Owen
7,020,918 B1 * 4/2006 Tinsley ..... A61G 13/009 5/652
D566,448 S 4/2008 Ridder
7,536,741 B1 * 5/2009 Schultz ..... A47C 27/148 5/733
7,647,660 B2 1/2010 Tullous
D618,354 S 6/2010 Francucci et al.
7,941,883 B2 5/2011 Moule et al.
8,196,241 B2 * 6/2012 Balonick ..... A47C 31/08 5/730
9,084,703 B1 7/2015 Fair
9,295,599 B2 3/2016 Dyevich et al.
9,386,859 B2 7/2016 Schultz
9,545,157 B2 1/2017 Smith
D793,108 S 8/2017 Griffin
9,808,087 B1 11/2017 Ghazal
10,548,789 B2 2/2020 Dyevich et al.
10,842,287 B1 * 11/2020 Vigil ..... A47C 21/044
11,896,153 B2 * 2/2024 Hall ..... A47G 9/0246
2005/0193490 A1 9/2005 Macdonald
2006/0096034 A1 * 5/2006 Tucci ..... A47C 27/148 5/722
2006/0168726 A1 8/2006 Cushing
2009/0217459 A1 9/2009 Rudolph
2010/0101023 A1 4/2010 Stephens
2010/0199436 A1 * 8/2010 Schultz ..... A47C 27/146 5/632
2011/0004999 A1 1/2011 Hale et al.
2013/0081208 A1 * 4/2013 Dyevich ..... A47C 27/144 5/727
2013/0145555 A1 * 6/2013 Hargreaves ..... A47D 15/001 5/655
2016/0174726 A1 * 6/2016 Smith ..... A47C 20/025 5/735
2016/0286975 A1 * 10/2016 Breier ..... A47C 27/14
2017/0156508 A1 6/2017 Segal et al.
2019/0045949 A1 2/2019 Duck
2019/0174929 A1 * 6/2019 Page ..... A61G 13/122
2020/0261292 A1 * 8/2020 Stephens ..... A61G 7/05723
2021/0289949 A1 * 9/2021 Moore ..... A47C 27/146
2021/0307520 A1 * 10/2021 Batey ..... A47C 27/001

FOREIGN PATENT DOCUMENTS

GB 1518845 7/1978
WO 9524848 9/1995
WO 2007092243 8/2007

* cited by examiner

BED WITH NEGATIVE SPACE

CROSS-REFERENCE TO RELATED APPLICATION

This patent application is a continuation of U.S. patent application Ser. No. 16/926,502, filed Jul. 10, 2020, titled "Bed with Negative Space," which application is incorporated in its entirety here by this reference.

TECHNICAL FIELD

This invention relates to beds.

BACKGROUND

Traditional mattress designs only allow a sleeper to lay flat, causing discomfort, aches and pains for a large percentage of the population due to the lack of three-dimensional space needed to conform to the shape of the human body. The traditional flat mattress design often results in poor support for neck, shoulder, and back muscles and joints, preventing full comfort for side and stomach sleeping positions, as well as causing overlapping space requirements when sharing a mattress with another sleeper.

For the foregoing reason there is a need for beds that allow three-dimensional movement of a user's shoulders, arms and neck, greatly increasing comfort by supporting the body in the proper locations, allowing space in the proper locations as well as providing multiple support layers to accommodate for the overlapping of an additional sleeper's limbs in the channel's three-dimensional space.

SUMMARY

The present invention is directed to a bed that maintains the rectangular shape of traditional mattresses only for its footprint or from plan-view, but comprises a channel or negative space formed in the upper torso area of the bed to accommodate three-dimensional movement of the user. The negative space is configured and dimensioned to receive the arms and shoulder of the user and is formed into the foundation of the bed. In addition, auxiliary components of the bed, such as pillows and sheets can also be placed in the negative space. The foundation also comprises an upper torso region, and transition region in which an angled wall descends to a flat, lower torso region. A cushion can be placed on top of the lower torso region. The cushion also has a sloped wall corresponding with the angled wall of the foundation. An upper layer can be placed on top of the foundation and cushion layer for added comfort. A cutout is formed in the upper layer to correspond with the negative space so that the negative space is accessible through the upper layer. Specially designed channel pillows and a support layer are provided to place inside the negative space to provide support for the user.

DETAILED DESCRIPTION OF THE INVENTION

Figure 1:
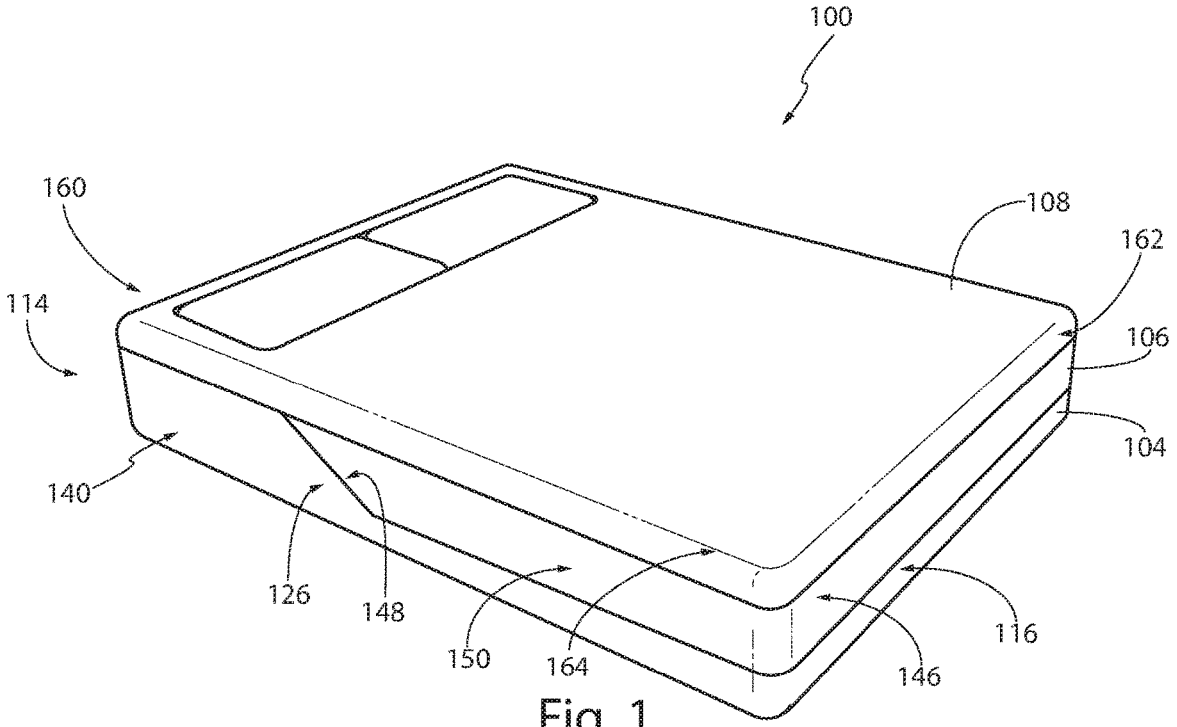
FIG. 1 shows a perspective view of the top side of an embodiment of the bed.
Figure 2:
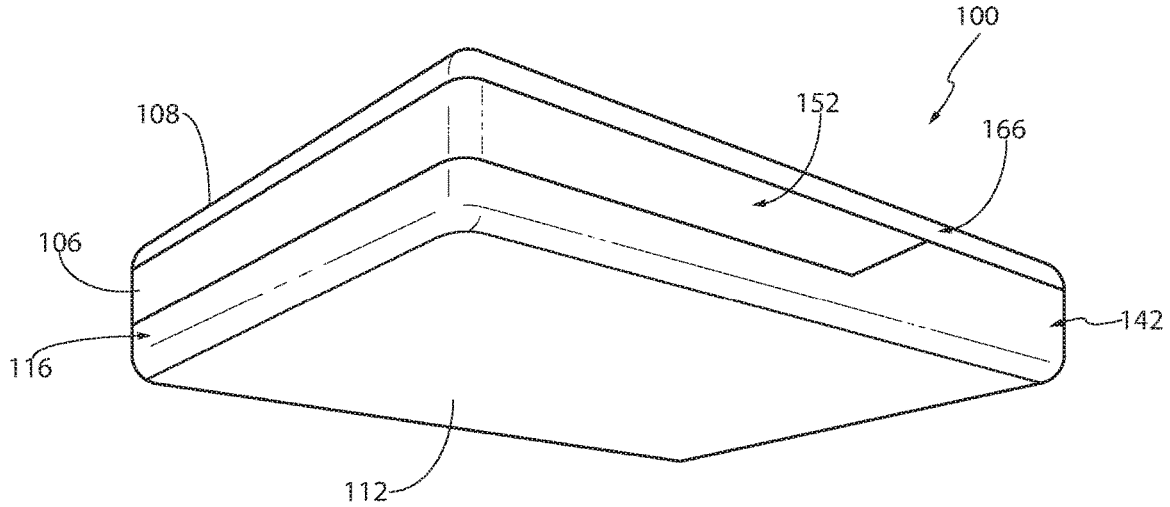
FIG. 2 shows a perspective view of the bottom side of the bed.

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

With reference to the FIGS. 1-8, the invention of the present application is a bed 100 that contains a negative space 102 (empty space or channel) at the region of the head and shoulders (i.e. the upper torso region) for allowing users to insert their arms into the negative space 102 when lying on their sides or backs. The negative space 102 can also be used to store bed accessories, such as pillows and blankets, which can also provide support for the user. The bed 100 comprises different layers for support and comfort. For example, the bed 100 comprises a foundation 104 and a cushion layer 106. In some embodiments, the bed can further comprise an upper layer 108. Additional layers may be added using various mattress materials, technologies, and techniques to tailor the amount of support and comfort to accommodate user preferences.

Figure 4:
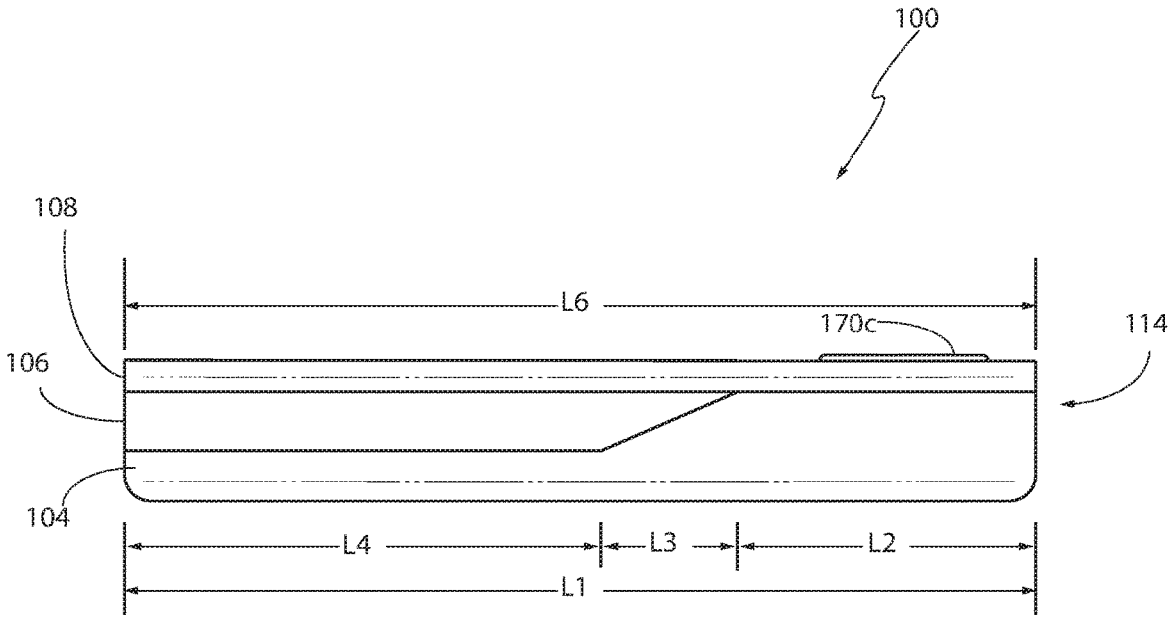
FIG. 4 shows an elevation view from a first side of the bed.

The foundation 104 makes up the base of the bed 100 and has resilient, highly supportive properties. For example, the foundation 104 can be made up of foam, wood, metal, and other material typically used for foundation of a bed, or any combination thereof. The foundation 104 comprises a top surface 110, a bottom surface 112 opposite the top surface 110, a head end 114 adjacent to the top surface 110 and the bottom surface 112, a foot end 116 opposite the head end 114 and adjacent to the top surface 110 and the bottom surface 112, a first side 140 adjacent to the head end 114, the foot end 116, the top surface 110, and the bottom surface 112, and a second side 142 opposite the first side 140 and adjacent to the head end 114, the foot end 116, the top surface 110, and the bottom surface 112. The top surface 110 and bottom surface 112 are generally flat, horizontal, and parallel to each other except as described in more detail below. As shown in FIG. 4, the length L1 of the foundation 104 as measured from the head end 114 to the foot end 116 is typical of standard bed sizes, for example, about 75 inches for twin and full size beds, about 80 inches for queen, king, and twin XL size beds, about 84 inches for California king size beds, or any other custom length. The width W1 of the foundation 104 (see FIG. 8) as measured from the first side 140 to the second side 142 can be typical of standard bed size, for example, about 39 inches for twin size beds, about 54 inches for full size beds, about 60 inches for queen size beds, about 76 inches for king size beds, about 72 inches for California king size beds, or any other custom width.

Figure 5:
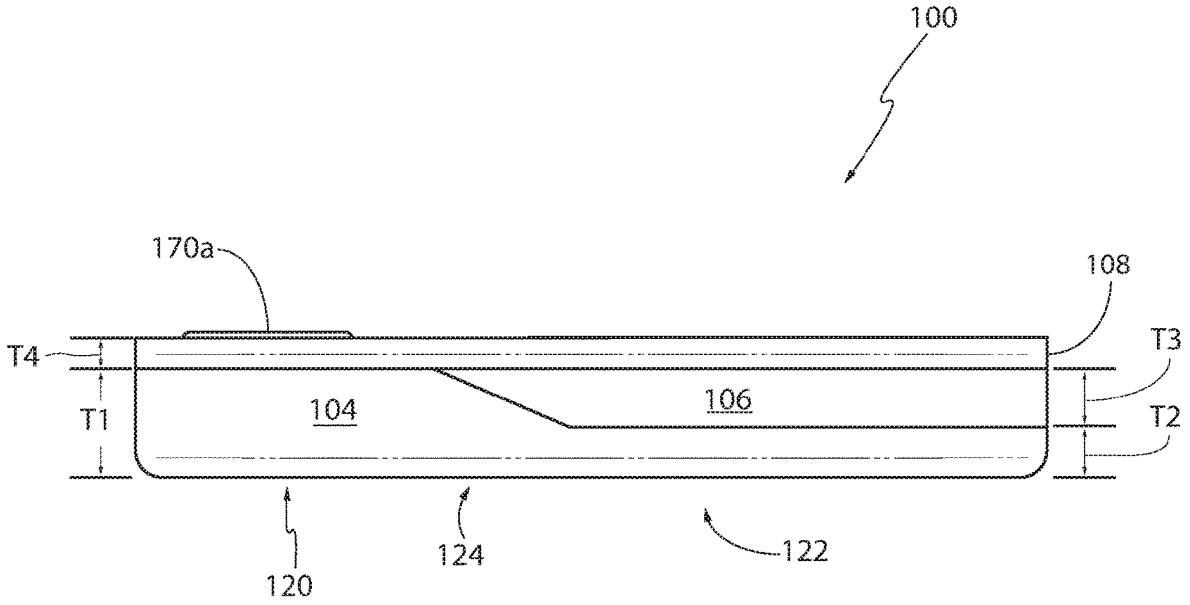
FIG. 5 shows an elevation view from a second side of the bed.
Figure 6:
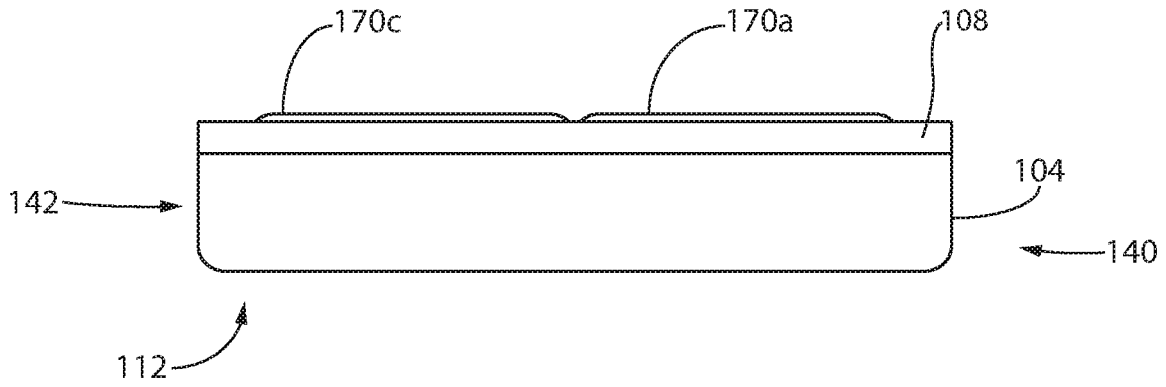
FIG. 6 shows an elevation view from the head end of the bed.
Figure 7:
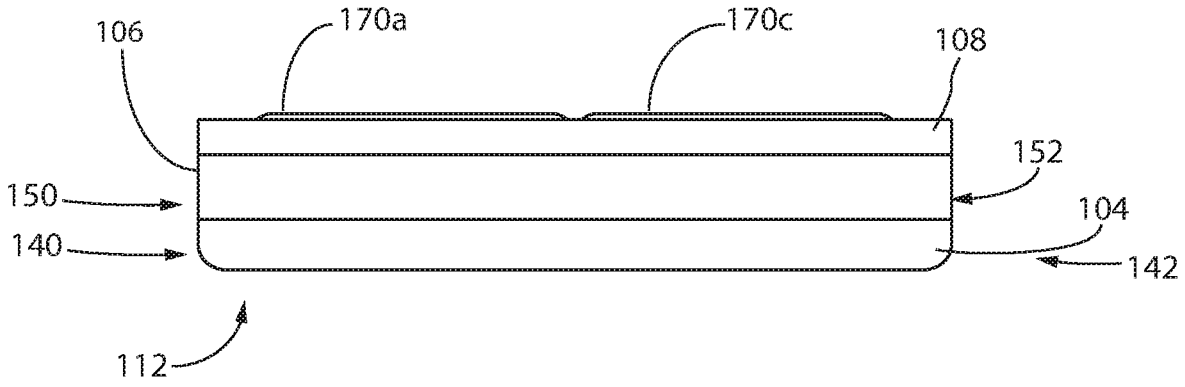
FIG. 7 shows an elevation view from the foot end of the bed.
Figure 8:
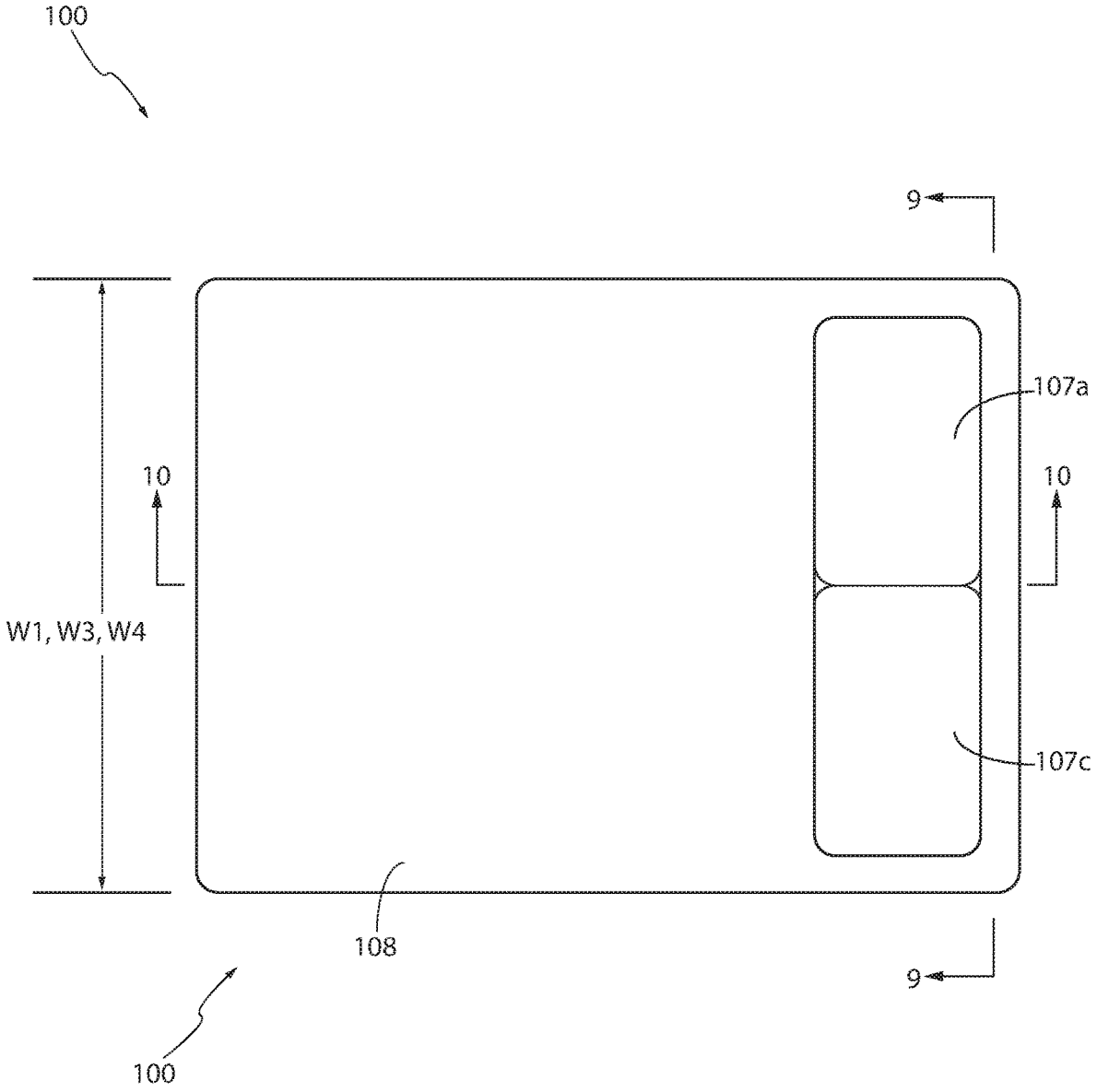
FIG. 8 shows a plan view from the top of the bed.

As shown in FIG. 5, the foundation 104 has an upper torso region 120 having a first thickness T1 (defined as the distance from the top surface 110 to the bottom surface 112 at the upper torso region 120) extending from the head end 114, and a lower torso region 122 having a second thickness T2 (defined as the distance from the top surface 110 to the bottom surface 112 at the lower torso region 122) extending to the foot end 116. The thickness T1 of the upper torso region 120 is greater than the thickness T2 of the lower torso region 122.

Figure 10:
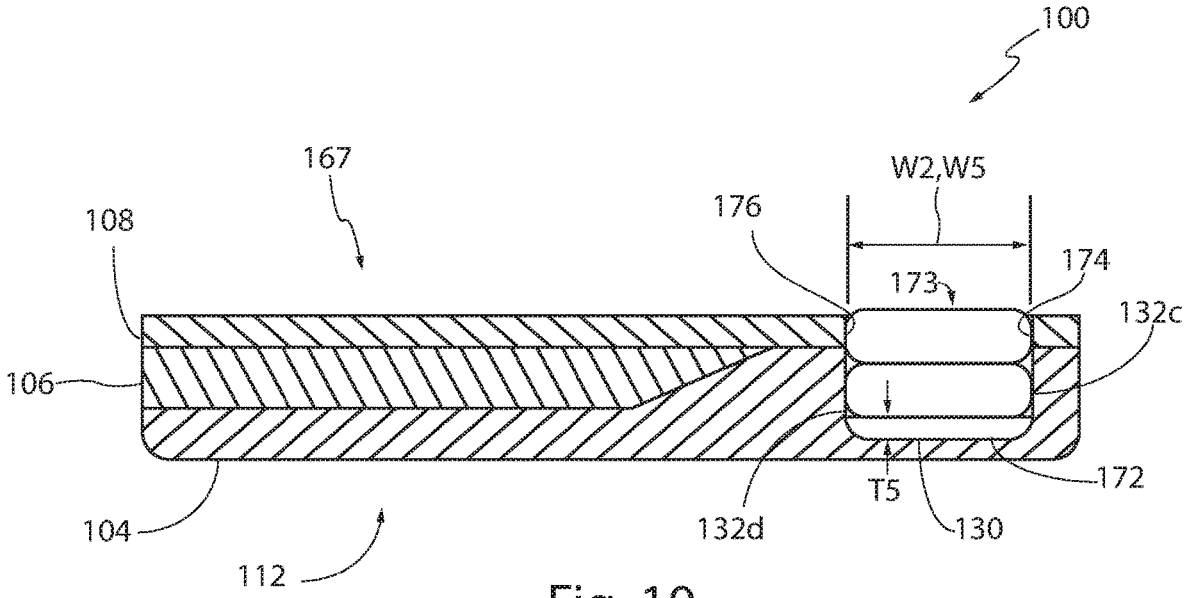
FIG. 10 shows a cross sectional view from the side of the bed taken at line 10-10 in FIG. 8.
Figure 11:
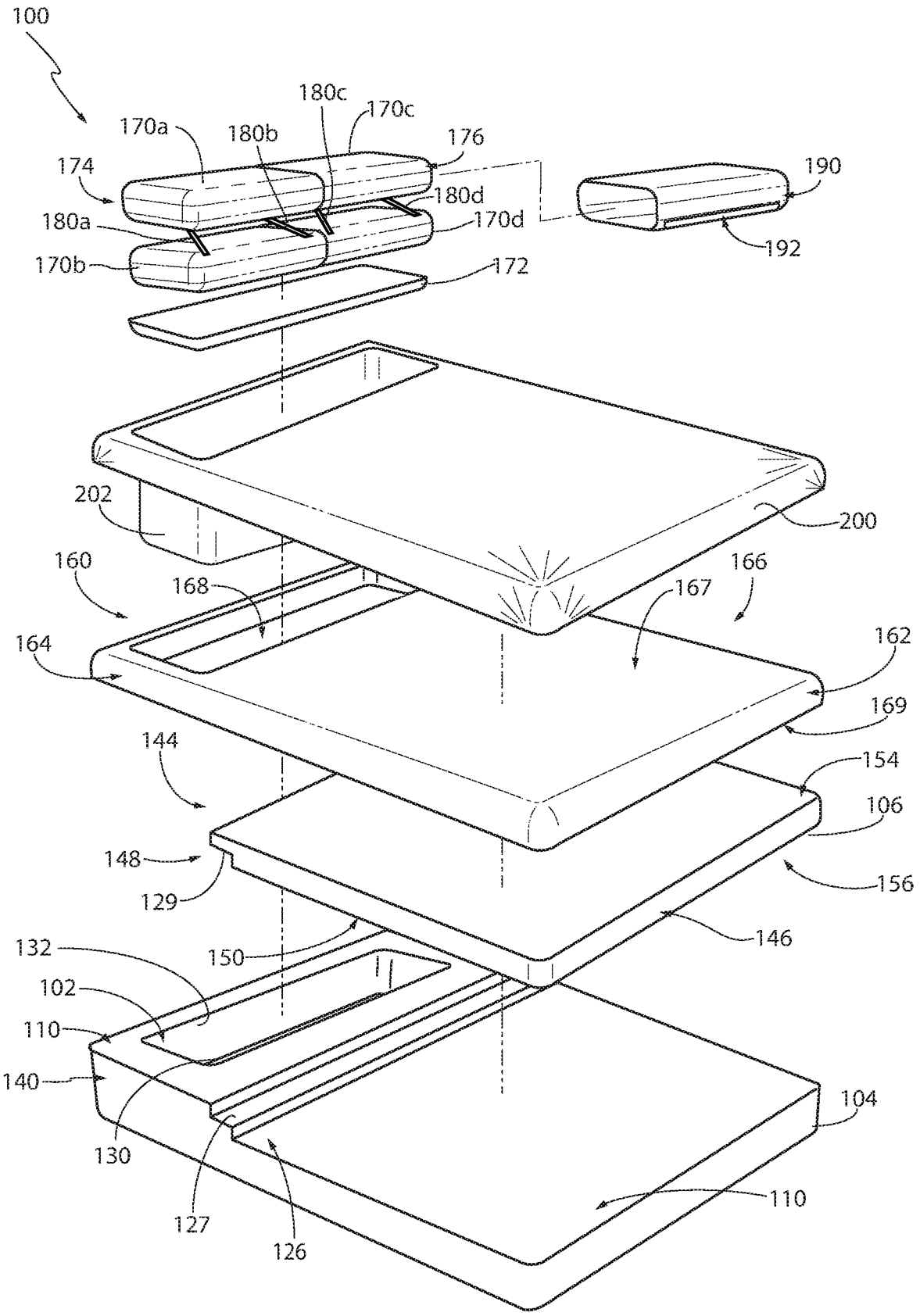
FIG. 11 shows an exploded view of another embodiment of the present invention.
Figure 12:
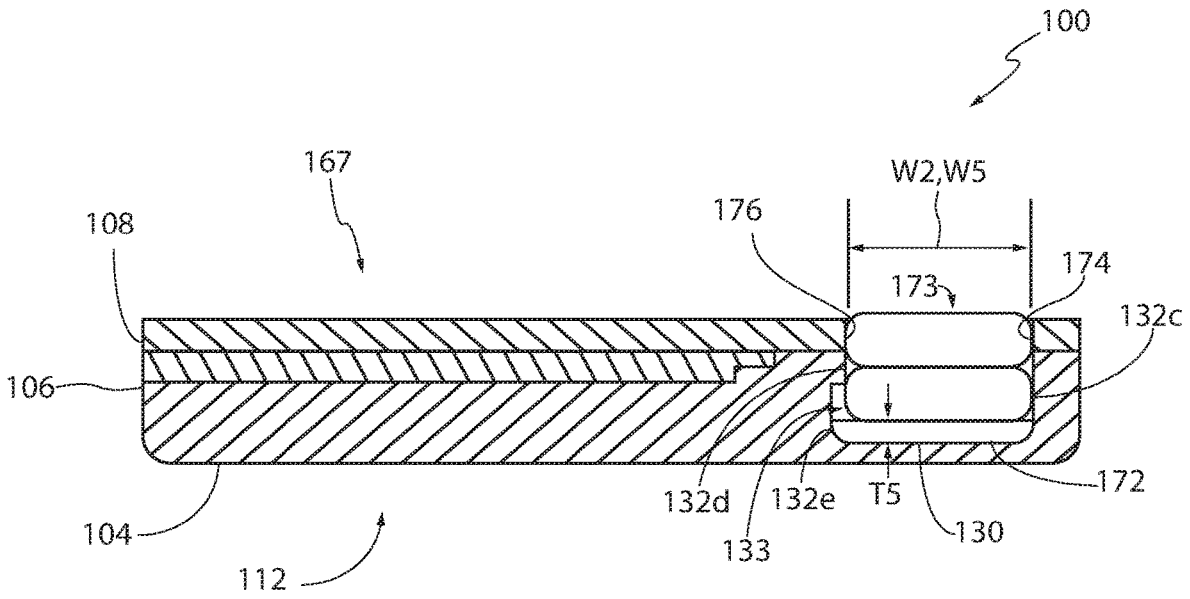
FIG. 12 shows a cross sectional view from the side of the bed taken at line 10-10 in FIG. 8, but showing the embodiment of FIG. 11.
Figure 13:
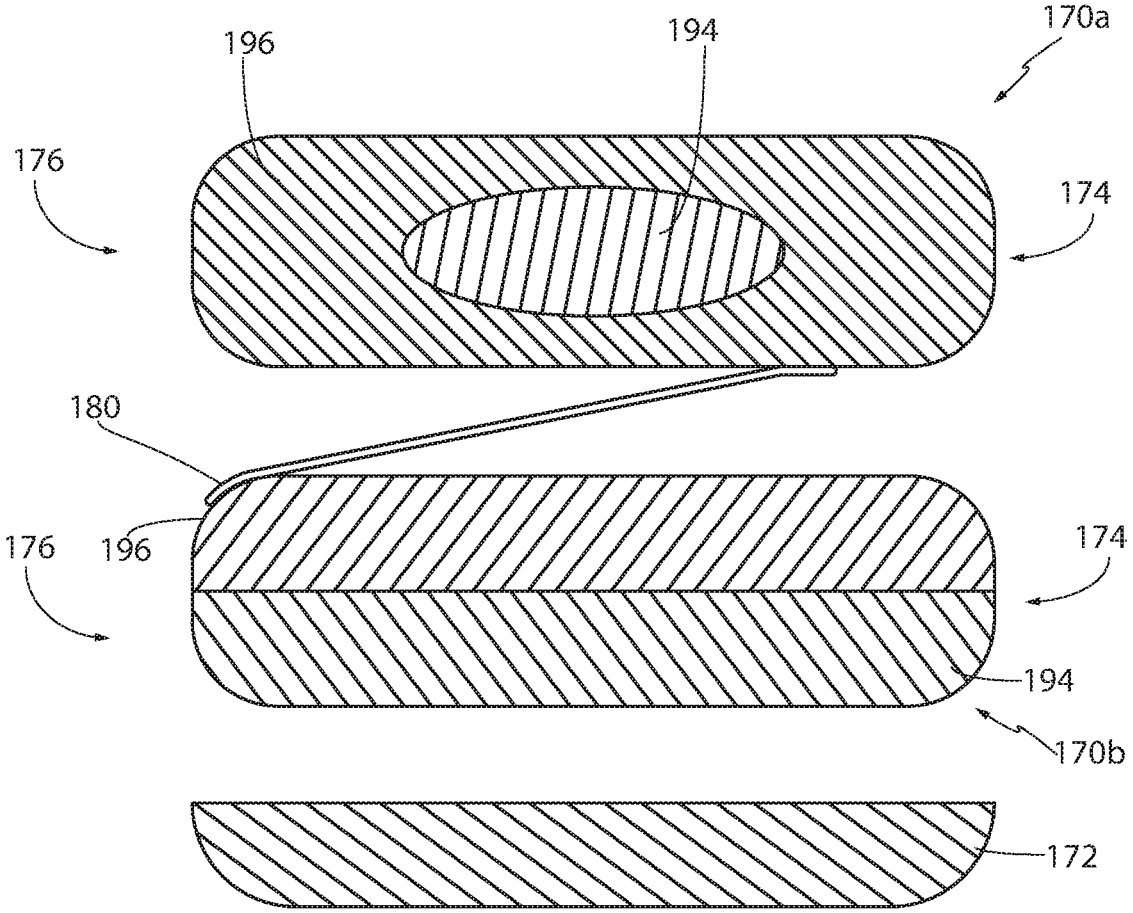
FIG. 13 shows a cross sectional exploded view of the channel pillows and support layer that fits into the negative space.

The foundation 104 also has a transition region 124 where the upper torso region 120 transitions into the lower torso region 122 moving from the head end 114 to the foot end 116. In some embodiments, the transition region 124 comprises a vertical wall perpendicular to the top surface 110 and the bottom surface 112, thereby creating and abrupt transition from the upper torso region 120 to the lower torso region 122. In some embodiments, the transition region 124 comprises an angled wall 126 between the top surface 110 at the upper torso region 122 and the top surface 110 at the lower torso region 122. Thus, while the top surface 110 is generally parallel to the bottom surface 112, a portion of the top surface 110 of the foundation 102 in the transition region 124 may not be parallel to the bottom surface 112 of the foundation 102. As such, in the preferred embodiment, the foundation 104 has a top surface 110 that has a flat, horizontal upper torso region 120 parallel to the bottom surface 112 that begins at the head end 114 and remains flat up to the transition region 124, and merges into the angled wall 126 creating a sloped transition region 124, and transitions into the top surface 110 of the lower torso region 122 that is again flat and parallel to the bottom surface 112 and remains flat and parallel to the bottom surface 112 from the transition region 124 to the foot end 116, as shown in FIGS. 1 and 10. In the preferred embodiment, the transition region 124 can be stepped as shown in FIGS. 11 and 12. As such, the transition region 124 can mimic a staircase. In other words, the angled wall 126 is stepped instead of being a smooth slope. Therefore, as used in this application, the angled wall 126 or slanted wall 148 refers to the general angled nature of the transition region, and can include a series of right angled walls that form a staircase giving a generally angled or slanted appearance.

The upper torso region 120 further defines the negative space 102. The negative space 102 is a hollow space or channel defined by a floor 130 and at least one sidewall 132. As such, the negative space 102 can be of many different shapes, such as circular, oval, square, rectangular, and the like. Preferably, the negative space 102 has generally a box-shape or rectangular cuboid shape. As such, the negative space is defined by a floor 130 and four sidewalls 132*a-d*. The area of the negative space 102 can occupy about 35 percent to about 75 percent of the area of the top surface 110 of the area upper torso region 120. Preferably, the area of the negative space 102 can occupy about 45 percent to about 65 percent of the area of the top surface 110 of the upper torso region 120. More preferably, the area of the negative space can occupy about 50 percent to about 60 percent of the area of the top surface 110 of the upper torso region 120. For example, in some embodiments, the area of the negative space occupies about 55 percent of the area of the top surface 110 of the upper torso region 120.

In some embodiments, a portion of the sidewall 132*d* that is nearest to the transition region 124 or the angled wall 126 may have a recessed wall 132*e* thereby creating an additional cutout 133 within the negative space 102. Specifically, a bottom portion of the sidewall 132*d* may have a recessed wall 132*e* that is moved closer to the angled wall 126 or the transition region 124 of the foundation 104. Therefore, a rectangular cutout 133 is formed underneath the top surface 110 of the foundation 104 in the upper torso region 120. Preferably, the cutout 133 extends the full length L5 of the negative space 104. This cutout 133 creates an additional space for the arms of the user who have inserted their arms into the negative space.

In the preferred embodiment, the foundation layer 104 at the head end 114 has a thickness T1 ranging from about 4 inches to about 20 inches. Preferably, the thickness T1 of the foundation layer 104 at the head end 114 is about 8 inches to about 16 inches. More preferably, the thickness T1 of the foundation layer 104 at the head end is about 11 inches to about 14 inches.

The thickness T2 of the foundation layer 104 at the foot end 116 can range from about 2 inches to about 8 inches. Preferably, the thickness T2 of the foundation layer 104 at the foot end 116 can range from about 4 inches to about 6 inches. For example, the thickness T2 of the foundation layer 104 at the foot end 116 can be about 5 inches.

The length L2 of the upper torso region 120 ranges from about 16 inches to about 30 inches. In other words, the transition region 124 can start at about 16 inches to about 30 inches from the head end 114 of the foundation 104. Preferably, the length L2 of the upper torso region 120 is about 21 inches to about 28 inches. More preferably, the length L2 of the upper torso region 120 is about 24 inches to about 26 inches.

The transition region 124 has a length L3 that can range from about 4 inches to about 16 inches. For example, the length L3 of the transition region 124 has a length L3 that can range from about 10 inches to about 14 inches. In some embodiments, the length L3 of the transition region 124 can range from about 11 inches to about 13 inches. In some embodiments, the length L3 of the transition region 124 can range from about 4 inches to about 8 inches. For example, the length L3 of the transition region 124 can be from about 5 inches to about 6 inches. In the stepped angled wall embodiment, each step 127 can be defined by its rise (vertical rise) and run (horizontal run). As such, the length L3 of the transition region 124 can be the sum of the runs of all of the steps within the transition region 124. Therefore, by way of example only, if there is only one step 127 as shown in FIG. 11, then the run of that step can be about 5 inches to about 8 inches. If there were two steps, each step 127 can have smaller run of about 2 inches to about 4 inches. The rise of each step can similarly be dependent on the number of steps 127 within the transition region 124. For example, the rise of each step can range from about 1 inch to about 5 inches. In some embodiments, the rise of each step can range from about 2 to about 3 inches or 4 inches.

The lower torso region 122 has a length L4 that can range from about 31 inches to about 51 inches. Preferably, the length L4 of the lower torso region 122 has a length L4 that can range from about 36 inches to about 48 inches. Most preferably, the lower torso region 122 has a length L4 that can range from about 42 inches to about 46 inches.

Figure 9:
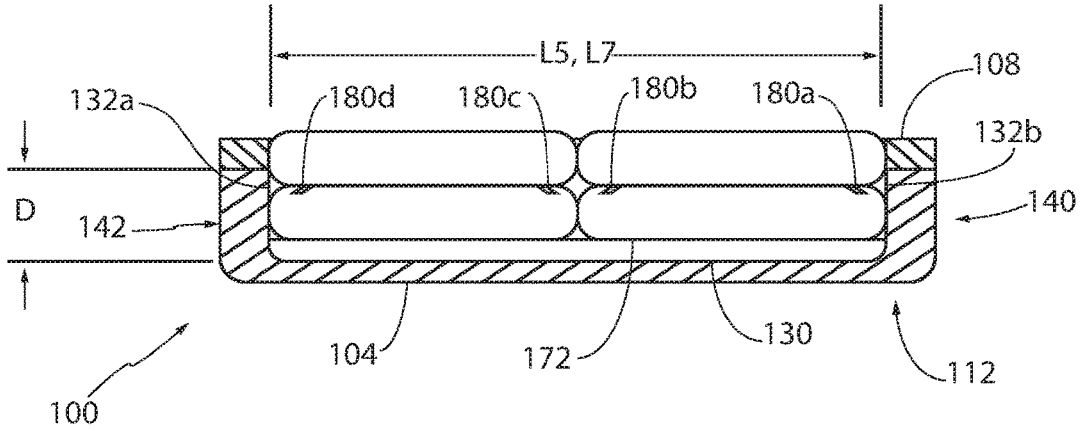
FIG. 9 shows a cross sectional view from the head end of the bed taken at line 9-9 in FIG. 8.

As shown in FIG. 9, the depth D of the negative space 102 as measured from the top of one of the sidewalls 132*a-d* to the top of the floor 103 can range from about 5 inches to about 15 inches. Preferably, the depth D of the negative space 102 can range from about 7 inches to about 13 inches. More preferably, the depth D of the negative space 102 can range from about 9 inches to about 11 inches. The length L5 of the negative space 102 measured in the direction of one sidewall 132*a* defining the negative space 102 adjacent to one side 142 of the foundation 104 towards the opposite side wall 132*b* defining the negative space adjacent to the opposite side 140 of the foundation 104 varies considerably depending on the size of the foundation 104 (i.e. twin, full, queen, king, California king, etc.). In general, the negative space 102 can be set inwardly from each side 140, 142 (i.e. towards the center of the foundation) by about 1 inch to about 6 inches. Preferably, the negative space 102 can be set inwardly from each side 140, 142 by about 2 inches to about 5 inches. Most preferably, the negative space 102 is set inwardly from the sides 140, 142 by about 3 inches to about 4 inches on each side 140, 142. The width W2 of the negative space 102 (as measured from the sidewall 132*c* adjacent to the head end 114 to the sidewall 132*d* adjacent to the transition region 124) can be offset inwardly from the head end 114 (i.e. towards the transition region) and inwardly from the transition region 124 (i.e. towards the head end) by about 1 inch to about 6 inches. Preferably, the negative space 102 can be set inwardly from the head end 114 and the transition region 124 by about 2 inches to about 5 inches on each side. More preferably, the negative space 102 can be set inwardly from the head end 114 and the transition region 124 by about 3 inches to about 4 inches on each side. The distance between the negative space 102 and the head end 114 need not be the same as the distance between the negative space 102 and the transition region 124.

To improve the comfort level of the bed 100, the bed 100 further comprises a cushion layer 106. In the preferred embodiment, the cushion layer 106 is trapezoid shaped and is configured to cover the transition region 124 and the lower torso region 122 of the foundation 104, and has softer, memory-style supportive properties. As such, the cushion layer 106 has a first side 150, a second side opposite the first side 152, a top surface 154 adjacent to the first side 150 and the second side 152, a bottom surface 156 parallel to the top surface 154 and adjacent to the first side 150 and second side 152, an upper torso side 144 adjacent to the top surface 154, the bottom surface 156, the first side 150 and second side 152, and a foot side 146 opposite the upper torso side 144 and adjacent to the top surface 154, the bottom surface 156, the first side 150 and second side 152, wherein the foot side 146 is adjacent and perpendicular to the top surface 154 and the bottom surface 156, but is non-parallel to the upper torso side 144. Therefore, the cushion layer 106 is more specifically a right trapezoid shape. Specifically, the upper torso side 144 has a slanted wall 148 that is slanted at the same angle as the angled wall 126 of the foundation 104. In some embodiments, the slanted wall 148 can be stepped to match a stepped transition region 124 as shown in FIG. 11. The thickness T3 of the cushion layer 106 (see FIG. 5) is generally the difference between the thickness T1 of the foundation 104 at the head end 114 and the thickness T2 of the foundation 104 at the foot end 116. The width W3 of the cushion layer 106 (see FIG. 8) as measured from a first side 150 of the cushion layer 106 to a second side 152 of the cushion layer 106 is substantially the same as the width W1 of the foundation 104. Therefore, when the cushion layer 106 is laid on top of the foundation 104, the sides 150, 152 of the cushion layer 106 aligns flush with sides 140, 142 of the foundation 104, and the foot end 146 of the cushion layer 106 aligns flush with the foot end 116 of the foundation 104. Furthermore, the top surface 154 of the cushion layer 106 aligns flush with the top surface 110 of the foundation 104 at the upper torso region 120, and the slanted wall 148 of the cushion layer 106 corresponds or mates perfectly with the angled wall 126 of the foundation 106. In some embodiments, fasteners (e.g. hook-and-loop, buttons, magnets, clips, hooks, and the like) can be used to connect the angled wall 126 to the slanted wall 148.

In some embodiments, to further improve the comfort, the bed 100 can further comprise an upper layer 108 that covers the entire top area defined by the cushion layer 106 and the foundation 104. The upper layer 108 can have the softest, most plush materials of the bed 100. The upper layer 108 comprises a head end 160, a foot end 162 opposite the head end 160, a first side 164 adjacent to the head end 160 and the foot end 162, and a second side 166 opposite the first side 164 and adjacent to the head end 160 and the foot end 162 of the upper layer 108. The length L6 and width W4 dimensions of the upper layer 108 (see FIGS. 4 and 8) is substantially similar to that of the foundation 104 so as to cover the entire top surface 110 of the foundation 104 and cushion layer 106. The upper layer 108 further comprises a cutout 168. The cutout 168 is dimensioned substantially similar to the length L5 and width W2 of the negative space 102 and positioned within the upper layer 108 so as to align with the negative space 102 when the upper layer 108 is placed properly on top of the foundation 104 and the cushion layer 106. The upper layer 108 has a thickness T4 (measured from the top surface 167 to the bottom surface 169, see FIG. 5) that can range from about 0.5 inch to about 5 inches. Preferably, the thickness T4 of the upper layer 108 is about 1 inch to about 4 inches. More preferably, the thickness T4 of the upper layer is about 2 inches to about 3 inches.

In order to support the upper torso of a user, the support layer 172 is placed on the floor 130 of the negative space to bolster the foundation layer 104 intersecting with the cushion layer 106 in a gradating shape. This trapezoidal shape allows the foundation layer 104 to gradually increase support towards the wall 132*d* at the foot of the negative space 102, enabling even support for the user's upper torso (most commonly the heaviest area of the body), while preventing the excessive compression of the areas closest to the negative space 102.

The intersecting trapezoids of the foundation layer 104 and the cushion layer 106 allow for the foundation layer 104 to replace the cushion layer 106, meeting the upper layer 108 for the remaining three walls 132*a-c* around the negative space 102 in order to further bolster support for the negative space 102.

With reference to FIGS. 9-10, inside the negative space 102, can be a set of specifically designed channel pillows 170*a*, 170*b* and a support layer 172. The support layer 172 can be placed on the floor 130 of the negative space 102, and the channel pillows 170*a*, 170*b* can be stacked on top of the support layer 172. The length and width of the support layer 172 is dimensioned substantially similar to the length L5 and width W2 dimensions of the negative space 102 so as to fit snuggly inside the negative space 102. The thickness T5 of the support layer 172 can vary depending on the thickness of the channel pillows so that when two channel pillows 170*a*, 170*b* are stacked on top of each other, and placed on top of the support layer 172 laying on the floor 130 of the negative space 102, the top surface 173 of the top channel pillow 170*a* is generally flush with the top surface 167 of the upper layer 108. Regular sleeping pillows can be placed on top of the channel pillow 170*a*. In some embodiments, the top surface 173 of the top channel pillow 170*a* can rise above the top surface 167 of the upper layer 108 so that the top channel pillow 170*a* can function as a sleeping pillow.

The channel pillows 170*a*, 172*b* are stacked on top of each other and on top of the support layer 172 to produce the correct amount of support to the user's head while the shoulders and/or arms are immersed in the negative space 102. The two layers of channel pillows 170*a*, 170*b* allow the user three levels of depth on which to rest their shoulders and arms within the negative space 102. These levels accommodate for different size users and all sleeping positions, while relieving pressure that would otherwise be applied by the traditional flat mattress design.

Preferably, the channel pillows 170*a-d* are stacked in pairs. For wider beds, such as queen, king, and California-king sizes, at least four channel pillows 170*a-d* may be used, two pairs on each side of the bed—two channel pillows 170*a*, 170*b* for the user on the left, and two channel pillows 170*c*, 170*d* for the right. Each channel pillow 170*a-d* has a head end 174 and a shoulder end 176. The head end 174 of a channel pillow 170*a-d* is aligned along the head end 114 side of the foundation 104 and is where the top of the head of the user would be closest to in proper usage, and the shoulder end 176 of a channel pillow 170*a-d* is aligned along the transition region 120 side of the foundation 104, and is where the shoulders of the users would be closest to in proper usage.

In some embodiments, a first channel pillow 170*a* can be connected to a second channel pillow 170*b* immediately below the first channel pillow 170*a* with a connector 180. For example, with reference to FIG. 12, in the preferred embodiment, the head end 174 of a first channel pillow 170*a* can be connected to the shoulder end 176 of the second channel pillow 170*b*, or vice versa with the shoulder end 176 of the first channel pillow 170*a* being connected to the head end 174 of the second channel pillow 170*b*. In another example, the head end 174 of a first channel pillow 170*a* can be connected to the head end 174 of a second channel pillow 170*b* immediately below the first channel pillow 170*a* with a connector 180. Alternatively, the shoulder end 176 of a first channel pillow 170*a* can be connected to the shoulder end 176 of a second channel pillow 170*b* immediately below the first channel pillow 170*a*.

Figure 3:
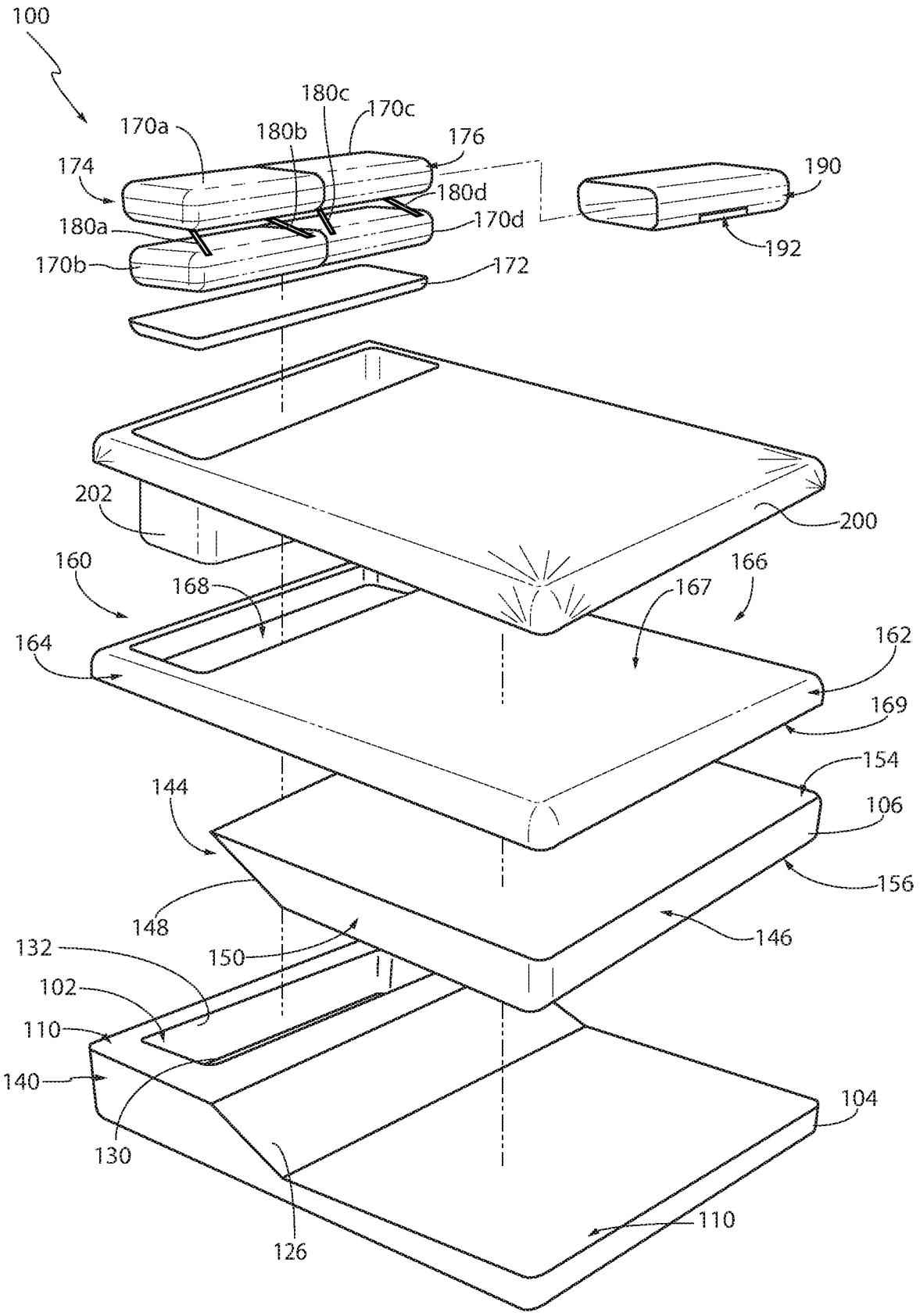
FIG. 3 shows an exploded view of the bed.

The connector 180 can be any kind of strap, such as an elastic strap. Multiple straps 180*a*, 180*b* can be used to keep the stacked channel pillows aligned and in place throughout the night. Even more connectors 180*a-d* can be used for more channel pillows 170*a-d*. In a preferred embodiment, the connectors 180*a*, 180*b* may be arranged non-parallel to each other. For example, the connectors 180*a*, 180*b* can be attached to the top channel pillow 170*a* or bottom channel pillow 170*b* near the corners at the should end 176. The opposite sides of the connectors 180*a*, 180*b* near the head end 174 can be angled towards each other as shown in FIG. 3. In another example, the connectors 180*a*, 180*b* can be arranged parallel to each other with a first connector 180*a* can be placed near the first head end 174 corners of a top channel pillow 170*a* and its bottom channel pillow 170*b*, and a second connector 180*b* can be placed at the opposite head end 174 corners of the top and bottom channel pillows 170*a*, 170*b*. Having connectors 180*a*, 180*b* at opposite corners resists lateral movement of the stacked channel pillows 170*a-d*. The connectors 180*a*, 180*b* can be fixed (e.g., stitched) to the paired channel pillows 170*a*, 170*b*, and 170*c*, 170*d*, or can be reversibly attached using mating fasteners, such as hook-and-loop fasteners, magnets, snap buttons, hooks, clips, and the like. This embodiment allows the channel pillow pairs 170*a*, 170*b* or 170*c*, 170*d* to be separated. In some embodiments, the connectors 180 can be removed and the channel pillows 170*a*, 170*b* can be attached directly together via the mating fasteners.

In some embodiments, the connectors 180 can be the mating fasteners without the need of a strap. For example, the bottom surface of the top channel pillow 170*a* can have a large patch of one mating fastener 182 (the hook or loop) of a hook and loop fastener, and the top surface of the bottom channel pillow 170*b* can have the complementary mating fastener 184 (loop or hook, respectively) of the hook-and-loop fastener. Because of the large surface area of the connector 180, the stacked channel pillow pair 170*a*, 170*b* resists lateral movement. With mating fasteners 182, 184 that cannot be presented as a large patch, the multiple mating fasteners 182, 184 can be strategically placed apart from each other to resist lateral movement of the top channel pillow 170*a* relative to the bottom channel pillow 170*b*, such as in the corners or along opposite edges of the channel pillow.

Pillow cases 190 are typically used with pillows. As such, pillow cases 190 (see FIG. 3) can be uniquely designed with openings 192 corresponding with the location of the connectors 180 so as not to obstruct the connection of the stacked channel pillows 170*a*, 170*b*. In some embodiments, the connectors 180 can be on the pillow cases 190. Therefore, rather than the channel pillows 170*a*, 170*b* being directly attached to each other, the channel pillows 170*a*, 170*b* can be attached through their respective pillows cases as described above.

In some embodiments, one large pillow case 190 can accommodate two stacked channel pillows 170*a*, 170*b*. In this embodiment, the two channel pillows 170*a*, 170*b* can be stacked on top of each other then slid into the large pillow case. Optionally, the channel pillows 170*a*, 170*b* can be stacked and connected to each other as described above, then slid into the large pillow case 190.

With reference to FIG. 11, the channel pillows 170*a-d* can be standard pillows. FIG. 11 shows an exploded view of a cross section through the center of the channel pillows 170*a*, 170*b* and support 172 from the head end 174 to the shoulder end 176. In some embodiments, each channel pillow 170*a-d* can made up of at least two types of support material. A first layer 194 can have a higher density compared to a second layer 196, thereby supplying vertical structural support, while the second layer 196 can have a lower density compared to the first layer 195 to provide comfort. Additional layering can be added to accommodate different levels of comfort for different users. In some embodiments, the two layers 194, 196 can be stacked one on top of the other. Therefore, a first side of the channel pillow can have a first layer 194 of higher density foam, while the opposite side of the channel pillow can have a second layer 196 of lower density foam. Preferably, the layers can be concentrically arranged with the first layer 194 of the higher density foam forming an inner core, and the second layer 196 of lower density foam wrapping around the first layer 194 as an outer shell. By way of example only, the first layer 194 can be a high density foam for structural support, whereas the second layer 196 can be of lower density memory foam to allow comfortable movement and placement of the user's shoulders and arms. This allows the channel pillows 170*a-d* to be reversible while providing the same type of support.

In the preferred embodiment, the composition of the channel pillows 170*a-d* can supply the same amount of vertical support as lower torso region of the bed. The thicknesses of the channel pillows 170*a*-170*d* can be configured such that when two channel pillows 170*a*, 170*b* are stacked on top of each other, the top 173 of the upper pillow 170*a* is generally flush with the top surface 167 of the upper layer 108, thereby enabling the bed 100 to maintain the flat plane of a traditional mattress when desired for back sleepers, while allowing lateral leeway for side and stomach sleepers. As this flat plane is maintained, a user's preferred head pillow can be placed on top of the channel pillows 170*a*, 170*b*. In some embodiments, the channel pillows 170*a-d* can be configured to rise slightly above the upper layer 108.

The bed 100 can further comprise a sheet 200 to cover at least the upper layer 108 and the negative space 102. Preferably, the sheet 200 is configured to reach all the way down to the bottom 112 of the foundation 104 Preferably, the sheet 200 is a fitted sheet that is contoured with additional material to create a pocket 202 that substantially covers the negative space 102 to allow proper coverage, ample room for movement of the user without adding unnecessary pressure on the channel walls, and to enable cleaning. As such, the fitted sheet 200 comprises a pocket 202 dimensioned similarly to the size and shape (i.e. length and width) of the negative space 102. The sheet 200 can be placed on top of the upper layer 108. Therefore, in the preferred embodiment, the height of the pocket would be substantially similar to the sum of the depth D of the negative space 102 and the thickness T4 of the upper layer 108 so that when the sheet 200 is placed on top of the upper layer 108, the pocket 202 can reach the floor 130 of the negative space 102.

Existing online mattress companies have proven a model for shipping memory foam mattresses in a compressed form directly to customers, who simply remove the packaging, allowing the full-size mattress to take shape from within packaging of much smaller dimensions. This technique makes it possible for these companies to eliminate brick and mortar mattress stores, save cost on delivery and installation, as well as have a direct relationship with customers.

The bed 100 of the present invention can be manufactured, packaged and delivered in this fashion, allowing the same benefits as existing companies, while introducing to customers the added advantages described herein.

The bed 100 of the present invention can stand alone as a complete bed due to the foundation layer 104. Because the dimensions of the foundation layer 104 are configured to match standard mattress sizes, the bed 100 can also be used with commercially available bed frames as well.

By way of example only, a king-size bed 100 of the present invention can have a total thickness of about 14 inches in height as measured from the bottom 112 of the foundation layer 104 to the top 167 of the upper layer 108, and be about 76 inches wide and about 80 inches long.

The negative space 102 can have a depth D of 10 inches from the top surface 110 of the foundation 104 at the upper torso end 120, a width W2 of about 16 inches and a length L5 of about 68 inches centered width-wise, and positioned 4 inches from the head end 114 of the foundation layer 104, and 4 inches from each side 140, 142 of the foundation layer 104. Ideally, in use, the transition region side of the negative space 102 is located just below the armpit of an average adult user when the top of the head of the user is positioned approximately about 6 to about 8 inches from the head end 114 of the bed 100. The position and dimensions of the negative space 102 allows the user's shoulder and arm to immerse into the negative space 102 when the arms are extended at least about 90 degrees from the torso in a side-sleeping position.

The foundation layer 104 has a thickness T1 of about 11 inches at the head-end 114 of the bed 100, and gradates or steps to a thickness T2 of about 5 to about 7 inches high (as measured at the foot-end 116 of the bed) over about a 5-inch to about a 12-inch transition region 124, which starts at about 26 inches from the head-end 114 of the bed 100 and terminates at the lower torso region 122, and the lower torso region 122 extends to the foot-end 116 of the bed 100. The width W1 of the foundation layer 104 is about 76 inches.

The cushion layer 106 has a thickness T3 of about 4 inches to about 6 inches at the foot-end 116 of the foundation 104, and extends from the foot end 116 until about 42 inches from the foot-end 116 of the bed 104 where it meets the foundation layer 104 and gradates over the same 5 to 12-inch sloped section where it ends at the top 110 of the upper torso region 120 of the foundation layer 104. The width W3 of the cushion layer is about 76 inches.

The upper layer 108 has a thickness T4 of about 3 inches, a width W4 of about 76 inches, and a length L6 of about 80 inches with a cutout 168 matching the position and dimensions (length and width) of the negative space 102.

The support layer 172 in the negative space has a thickness T5 of about 2 inches, a length L7 of about 68 inches, and a width W5 of about 16 inches to match the length and width dimensions of the negative space 102.

In the embodiment with a stepped transition region 124, the foundation 104 can have one, two, three, four, or five steps 127 in between the top surface 110 of the foundation 104 at the upper torso region 120 and the top surface 110 of the foundation 104 at the lower torso region 122. In other words, the transition region 124 of the foundation can comprise one, two, three, four, or five steps 127. In such an embodiment, the cushion layer 106 has the same complementary steps 129 to correspond and match with the steps 127 of the foundation 104. The stepped transition region 124 essentially descends from the top surface 110 at the upper torso region 120 to the top surface 110 at the lower torso region 122 causing the top surface 110 at the lower torso region 122 to be lower than the top surface 110 at the upper torso region 120.

In use, the user can lay the foundation 104 on the floor or within a bed frame. The cushion layer 106 is then placed on top of the foundation 104 with the slanted wall 144 of the cushion layer 106 placed against the angled wall 126 of the foundation 104. The upper layer 108 can be placed on top of the foundation 104 and the cushion layer 106 so that the cutout 168 of the upper layer 108 aligns with the negative space 102 of the foundation. The upper layer 108 covers the foundation 104 and the cushion layer 108 while leaving the negative space 102 open and accessible. A sheet 200 can be placed on top of the upper layer and fitted around the upper layer 108. In some embodiments, the sheet 200 can be fitted all the way down to the foundation 104. The pocket 202 of the sheet is placed into the negative space 102. A support layer 172 can be placed inside the negative space. Depending on the size of the bed, one pair of channel pillows 170*a*, 170*b* (one stacked on top of the other), or two pairs of channel pillows 170*a-d* (one pair 170*a*, 170*b* stacked next to a second pair 170*c*, 70*d*) can be placed on top of the support layer 172 inside the negative space. In some embodiments, the top of the channel pillows can be aligned substantially flush with the top 167 of the upper layer 108. In some embodiments, the top of the channel pillows can rise above the top 167 of the upper layer 108. Optionally, the user can place traditional pillows on top of the channel pillows 170*a-d*.

When the user lies down on the bed 100 on his or her side or stomach, the user's arms can be inserted in between the wall 132*d* that defines the negative space 102 and the channel pillows 170*a-d* into the negative space for comfortable position of the arms.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A bed, comprising:

a) a foundation, comprising: an upper torso region, a lower torso region, and a transition region therebetween, wherein the upper torso region defines a negative space having a length and a width;

b) a cushion layer configured to cover the transition region and the lower torso region; and c) an upper layer configured to cover the foundation and the cushion layer, and configured to access the negative space, wherein the upper torso region has a first thickness, and the lower torso region has a second thickness, wherein the first thickness is greater than the second thickness, wherein the transition region comprises an angled wall extending from the upper torso region to the lower torso region.

2. The bed of claim 1, wherein the cushion layer comprises a slanted wall configured to mate with the transition region of the foundation.

3. The bed of claim 2, further comprising a channel pillow configured to fit inside the negative space.

4. The bed of claim 3, wherein the channel pillow comprises a first layer having a first density, and a second layer having a second density, wherein the first density is higher than the second density.

5. The bed of claim 4, wherein the first layer forms an inner core of the channel pillow, and the second layer surrounds the first layer.

6. The bed of claim 4, further comprising a pair of channel pillows and a connector to attach a first channel pillow of the pair of channel pillows to a second channel pillow of the pair of channel pillows.

7. The bed of claim 4, further comprising a support layer having a length and width substantially similar to the length and width of the negative space to fit inside the negative space.

8. A bed, comprising:

a) a foundation, comprising: an upper torso region, a lower torso region, and a transition region therebetween, wherein the upper torso region defines a negative space having a length and a width;

b) a cushion layer configured to cover the transition region and the lower torso region; and c) an upper layer configured to cover the foundation and the cushion layer, and configured to access the negative space, wherein the upper torso region has a first thickness, and the lower torso region has a second thickness, wherein the first thickness is greater than the second thickness, wherein the transition region is stepped, and wherein the cushion layer comprises a slanted wall that is stepped to correspond with the stepped transition region.

9. A bed, comprising:

a) a foundation, comprising: an upper torso region, a lower torso region, and a transition region therebetween, wherein the upper torso region defines a negative space having a length and a width;

b) a cushion layer configured to cover the transition region and the lower torso region; and c) an upper layer configured to cover the foundation and the cushion layer, the upper layer defining a cutout, wherein the cutout has a length and width substantially similar to the length and the width of the negative space, wherein the transition region comprises an angled wall extending from the upper torso region to the lower torso region.

10. The bed of claim 9, wherein the cushion layer comprises a slanted wall configured to mate with the transition region of the foundation.

11. The bed of claim 10, further comprising a channel pillow configured to fit inside the negative space.

12. The bed of claim 11, wherein the channel pillow comprises a first layer having a first density, and a second layer having a second density, wherein the first density is higher than the second density.

13. The bed of claim 12, wherein the first layer forms an inner core of the channel pillow, and the second layer surrounds the first layer.

14. The bed of claim 11, further comprising a support layer having a length and width substantially similar to the length and width of the negative space to fit inside the negative space.

15. The bed of claim 10, further comprising a pair of channel pillows and a connector to attach a first channel pillow of the pair of channel pillows to a second channel pillow of the pair of channel pillows.

16. The bed of claim 10, wherein the transition region is stepped.

17. The bed of claim 16, wherein the cushion layer comprises a slanted wall that is stepped to correspond with the stepped transition region.

* * * * *